US012702191B2

(12) United States Patent
Kass

(10) Patent No.: US 12,702,191 B2
(45) Date of Patent: Aug. 11, 2026

(54) FOOTWEAR SOLE INCLUDING A SUPPORT MEMBER PROVIDING MEDIAL AND LATERAL SUPPORT

(71) Applicant: DECKERS OUTDOOR CORPORATION, Goleta, CA (US)

(72) Inventor: Stephen Kass, Carpinteria, CA (US)

(73) Assignee: Deckers Outdoor Corporation, Goleta, CA (US)

( * ) Notice: Subject to any disclaimer, the term of this patent is extended or adjusted under 35 U.S.C. 154(b) by 127 days.

(21) Appl. No.: 17/820,135

(22) Filed: Aug. 16, 2022

(65) Prior Publication Data

US 2024/0057714 A1 Feb. 22, 2024

(51) Int. Cl.
*A43B 13/18* (2006.01)
*A43B 7/142* (2022.01)
*A43B 7/143* (2022.01)

(52) U.S. Cl.
CPC ..... *A43B 13/181* (2013.01); *A43B 7/142* (2013.01); *A43B 7/143* (2013.01)

(58) Field of Classification Search
CPC ..... A43B 13/181; A43B 7/142; A43B 7/143; A43B 7/141; A43B 7/1445; A43B 3/0052; A43B 13/10; A43B 13/026
USPC ..... 36/91
See application file for complete search history.

(56) References Cited

U.S. PATENT DOCUMENTS 1,387,411 A 8/1921 Kolkebeck
1,484,785 A * 2/1924 Hiss ..... A43B 13/12 36/76 R
2,072,828 A * 3/1937 Schmidt ..... A43B 7/143 36/182
2,498,624 A * 2/1950 Skinner ..... A43B 3/0052 36/180
2,713,732 A * 7/1955 Guest ..... A43B 7/14 36/167
3,081,774 A * 3/1963 Lelyveld ..... A43B 7/142 36/174
5,025,573 A 6/1991 Giese et al.
5,528,842 A 6/1996 Ricci et al.
5,572,805 A 11/1996 Giese et al.
5,647,145 A * 7/1997 Russell ..... A43B 13/188 36/31

(Continued)

FOREIGN PATENT DOCUMENTS

CN 114098221 A * 3/2022
EP 3122198 B1 1/2019

(Continued)

OTHER PUBLICATIONS

PCT Search Report and Written Opinion for corresponding PCT Patent Application No. PCT/US2023/072292 dated Nov. 29, 2023 (7 pages).

*Primary Examiner* — Jameson D Collier
(74) *Attorney, Agent, or Firm* — Greer, Burns & Crain Ltd.

(57) ABSTRACT

An article of footwear including a sole including a midsole and an outsole attached to the midsole, where the sole includes a medial side and a lateral side and a support member positioned between the midsole and the outsole. The support member includes a body having a medial side and a lateral side, where the medial side and the lateral side of the body each include a pair of arms respectively extending toward the medial side and the lateral side of the sole.

11 Claims, 8 Drawing Sheets

(56) References Cited

U.S. PATENT DOCUMENTS 6,023,861 A * 2/2000 Bizzotto ..... A43B 13/12 36/179
6,119,370 A 9/2000 Baron
6,477,791 B2 11/2002 Luthi et al.
6,497,058 B2 12/2002 Dietrich et al.
6,499,235 B2 12/2002 Lussier et al.
6,502,330 B1 * 1/2003 David ..... A43B 13/12 36/43
9,462,845 B2 10/2016 Auger et al.
9,572,394 B2 2/2017 Heard et al.
9,629,413 B2 4/2017 Stien
10,010,137 B2 7/2018 Foxen
10,470,521 B2 11/2019 Iuchi et al.
2002/0062578 A1 5/2002 Lussier et al.
2004/0181971 A1 * 9/2004 Turkbas ..... A61F 5/14 36/88
2005/0246922 A1 * 11/2005 Gibert ..... A43B 13/12 36/27
2006/0201028 A1 * 9/2006 Chan ..... A43B 13/141 36/28
2008/0141562 A1 * 6/2008 Peveto ..... A43B 7/142 36/43
2010/0122472 A1 * 5/2010 Wilson, III ..... A43B 23/22 36/114
2012/0159814 A1 * 6/2012 Smith ..... A43B 7/14 36/76 R
2012/0233877 A1 9/2012 Swigart
2012/0317835 A1 * 12/2012 Raysse ..... A43B 13/145 36/31
2013/0111781 A1 * 5/2013 Jaeger ..... A43B 7/142 36/43
2014/0245640 A1 9/2014 Heard et al.
2014/0360052 A1 * 12/2014 Keating ..... A43B 13/188 36/76 R
2016/0000180 A1 1/2016 Cook et al.
2017/0079373 A1 * 3/2017 Huard ..... A43B 7/144
2017/0325543 A1 11/2017 Iuchi et al.
2018/0160773 A1 * 6/2018 Goldman ..... A43B 7/1445
2018/0338568 A1 * 11/2018 Chambers ..... A43B 13/04
2021/0059355 A1 * 3/2021 Vizy ..... A43B 13/141
2021/0227929 A1 * 7/2021 Ni ..... A43B 13/37
2021/0259351 A1 * 8/2021 Aubonnet ..... A43B 13/143
2021/0259358 A1 8/2021 Weidl et al.

FOREIGN PATENT DOCUMENTS

JP WO 2013145218 A1 10/2013
WO 2021201826 A1 10/2021

* cited by examiner

FOOTWEAR SOLE INCLUDING A SUPPORT MEMBER PROVIDING MEDIAL AND LATERAL SUPPORT

BACKGROUND

The present application relates generally to footwear, and more particularly, to a sole including a support member for footwear that supports a user's feet while efficiently transferring energy from the user's legs and feet to optimize running efficiency during walking, jogging and running while reducing fatigue.

Running involves the transfer of energy between a person's legs and feet and an underlying surface, such as the ground, contributing to the transfer of energy of a person in a forward direction along a trail, a sidewalk, a street or other path. The power a person is able to produce and the speed at which a person is able to move in a forward direction depends on a number of factors. For example, the ability to properly apply forces on a surface affects the energy produced and the rate of speed that the person is able to move. In particular, the energy generated by a person's legs and feet is important while jogging or running. Also, it is important to provide sufficient support and cushioning to a user's feet to reduce fatigue and help prevent injury.

Running outdoors, and more specifically, running on trails involves inclines, declines and different terrains and weather conditions. Due to these factors, it is important for a runner to maintain stability and control while running. It is also important for a runner's feet to be sufficiently supported and cushioned as they encounter different terrains, such as pavement in urban environments and gravel and rocks on trails and more rural environments.

It is therefore desirable to provide footwear that supports a person's feet during movement while optimizing the transfer of energy and maintaining support and stability to enhance a person's walking and running efficiency.

SUMMARY

The present article of footwear has a sole and a support member on the sole that provides enhanced stability, support and energy for different types of movement, such as walking or running, and on different types of terrain.

In an embodiment, an article of footwear is provided and includes a sole including a midsole and an outsole attached to the midsole, where the sole includes a medial side and a lateral side and a support member positioned between the midsole and the outsole. The support member includes a body having a medial side and a lateral side, where the medial side and the lateral side of the body each include a plurality of arms respectively extending toward the medial side and the lateral side of the sole.

In another embodiment, a sole for an article of footwear is provided where the sole includes a midsole and an outsole attached to the midsole and a support member positioned between the midsole and the outsole. The support member includes a body having a medial side and a lateral side, where the medial side and the lateral side of the body each include a pair of arms respectively extending toward the medial side and the lateral side of the sole.

DETAILED DESCRIPTION

The present invention includes a support member positioned on or within a sole of an article of footwear where the support member stabilizes and supports a user's feet during walking, jogging and running while enhancing the transfer of energy. More specifically, the present support member includes lever members or arms that extend toward a medial side of the sole and lever members or arms that extend toward a lateral side of the sole to provide additional support to the medial and lateral sides of the sole and enhance stability and the transfer of energy to a user's feet during movement.

Figure 1:
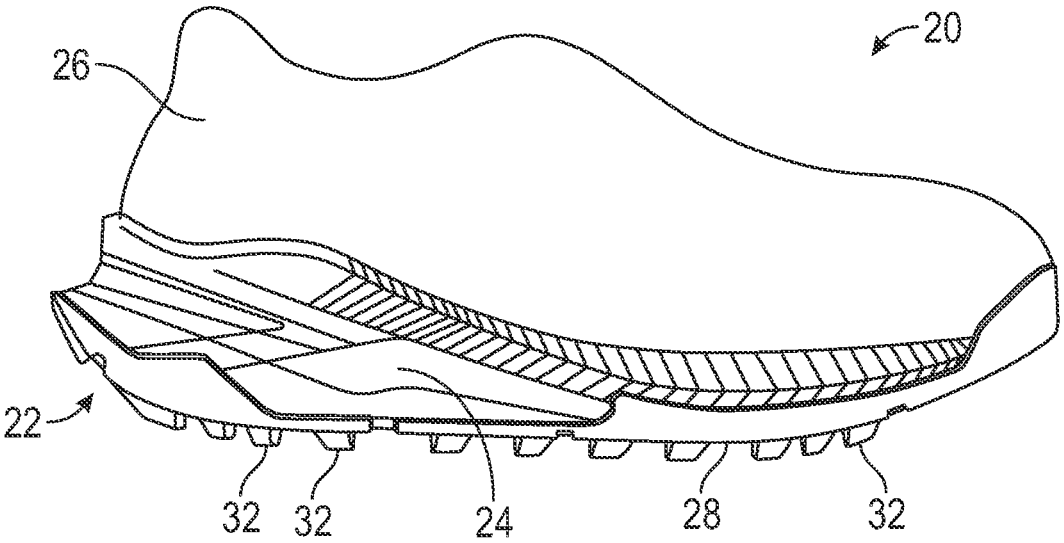
FIG. 1 is a perspective view of an embodiment of an article of footwear including the present support member.
Figure 2:
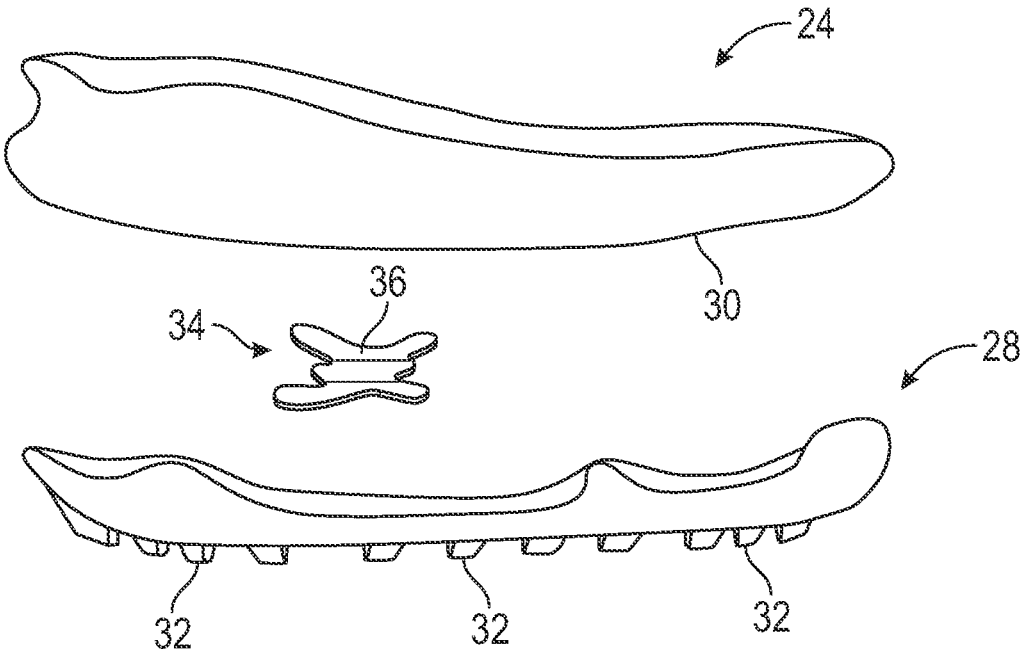
FIG. 2 is an exploded perspective view of the sole of the article of footwear of FIG. 1.

Referring now to FIGS. 1 and 2, an article of footwear 20 includes an embodiment of a sole, generally indicated as 22, where the sole 22 includes a midsole 24 attached to an upper 26, and an outsole 28 attached to the midsole. The midsole 24 may be an integral, molded component made of a material having a designated hardness value or made with different materials having the same or different hardness values. For example, one or more portions of the midsole 24 may be made with a material having a hardness or hardness value that is greater than a hardness or hardness value in other areas of the midsole to increase the stability and support in designated areas of the midsole. Preferably, the midsole is made with ethylene-vinyl acetate (EVA), but may also be made with thermoplastic polyurethane (TPU), a foam material or any suitable material or combination of materials. As shown in FIG. 1, the outsole 28 is attached to a bottom surface 30 of the midsole 24 by an adhesive or by molding, and is made of rubber. The outsole 28 typically includes a plurality of tread members 32 that are configured to grip an underlying surface, such as the ground, during movement. It should be appreciated that the midsole 24 and outsole 28 may be made of any suitable materials or combinations of materials.

Figure 3:
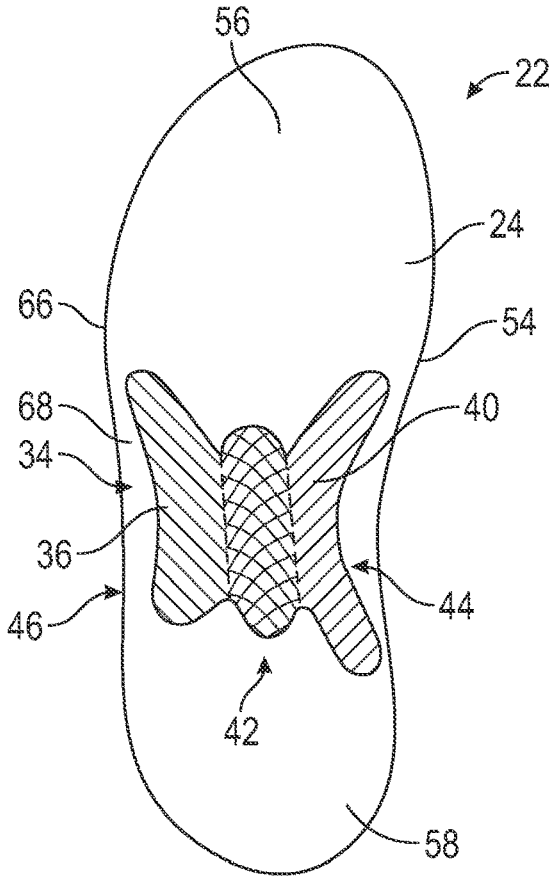
FIG. 3 is a bottom view of the sole of FIG. 2 showing the support member on the sole.

Referring to FIGS. 2-6, a support member 34 is placed between the midsole 24 and the outsole 28 to provide additional support to a user's feet during movement. In another embodiment, the support member 34 is embedded within or molded within the midsole 24. In another embodiment, the support member is placed on the upper surface of the sole 22, and more specifically, on the upper surface of the midsole 24. In this embodiment, the support member 34 includes a body 36 with a top surface 38 and a bottom surface 40 (FIGS. 4 and 5) and a central part 42, a medial part 44 on one side of the central part and a lateral part 46 on an opposing side of the central part where the body has an asymmetrical shape relative to the longitudinal axis 48 of the support member. Preferably, the body 36 including the central part 42, the medial part 44 and the lateral part 46 is integrally formed by molding or by another suitable manufacturing method. In another embodiment, the central part 42, the medial part 44 and the lateral part 46 of the body 36 are independently made or formed and then attached together by molding, by an adhesive or by another suitable attachment method. In this embodiment, the body 36 preferably has a uniform thickness, i.e., the distance between the top surface 38 and the bottom surface 40. For example, the thickness of the body 36 of the support member 34 in the illustrated embodiment is 1.5 mm. It should be appreciated that the body 36 may have different thicknesses. For example, in an embodiment, a thickness of the medial part 44 is greater than a thickness of the lateral part 46. In another example, the thickness of the lateral part 46 is greater than the thickness of the medial part 44. In a further embodiment, the thickness of the central part 42 of the body is greater than the thicknesses of the medial part 44 and the lateral part 46. Additionally as shown in FIG. 3, the medial part 44 of the body 36 is spaced from the medial side 54 (or medial edge) of the midsole 24 and the lateral part 46 of the body 36 is spaced from the lateral side 66 (or lateral edge) of the midsole 24.

Figure 4:
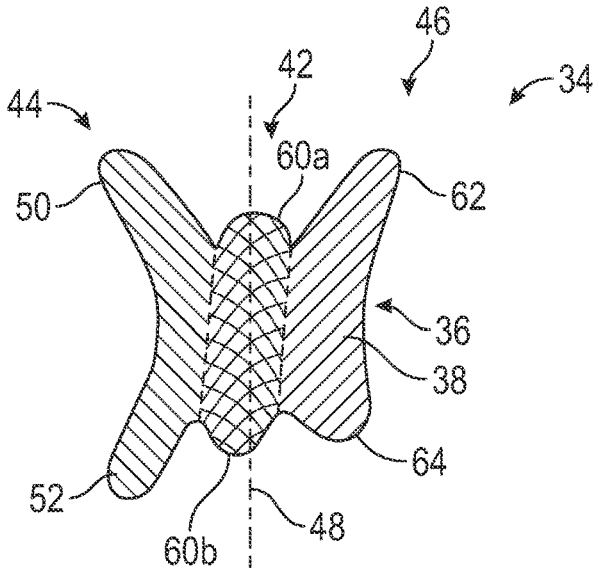
FIG. 4 is a top view of an embodiment of the support member.
Figure 5:
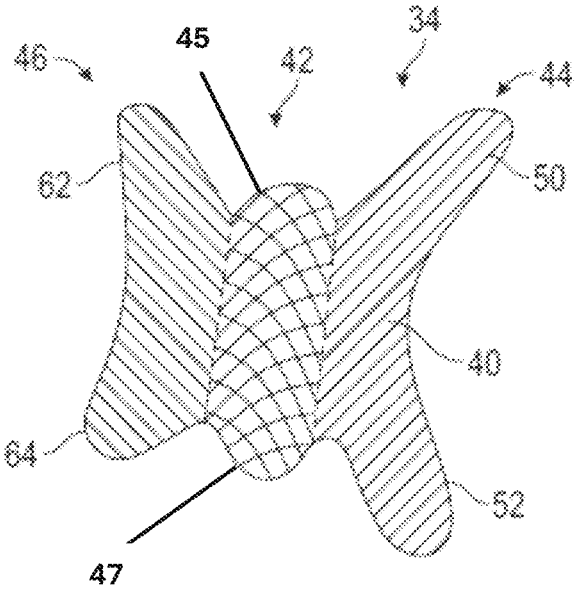
FIG. 5 is a bottom view of the support member.
Figure 6:
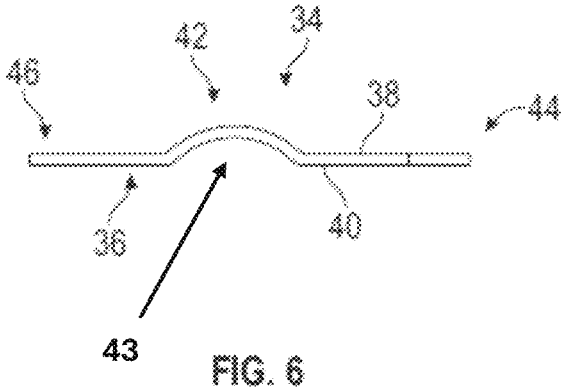
FIG. 6 is a front end view of the support member of FIG. 5.

As shown in FIGS. 4-6, the central part 42 of the support member 34 is curved to form a convex shape (vertically oriented curved shape) relative to the bottom surface 40 of the support member that defines a longitudinal space 43 (FIG. 6) below the central part 42 that extends from a front edge 45 to a rear edge 47 of the support member. In this embodiment, the central part 42 has a radius of curvature of 3.5 mm, but may have any suitable radius of curvature. As shown in FIG. 4, for additional support, the medial part 44 of the body 36 has a first lever member or a first arm 50 that extends along a medial side 54 of the sole 22 and toward the forefoot area 56, and a second lever member or a second arm 52 that extends along the medial side 54 of the sole and toward the heel area 58. In the illustrated embodiment, the first arm 50 and the second arm 52 of the medial part 44 of the body 36 each extend beyond the ends 60*a*, 60*b* of the central part 42. It should be appreciated that that first and second arms 50, 52 of the medial part 44 may be any suitable length. Further, the lengths of the first and second arms 50, 52 may be the same or different. It should also be appreciated that the medial part, the lateral part or both the medial part and the lateral part of the body may include a single first arm and a single second arm or a plurality of first and second arms, such as two or more first and second arms.

Similar to the medial part 44, the lateral part 46 of the body 36 includes a first arm 62 and a second arm 64, where the first arm extends along a lateral side 66 of the sole 22 and toward the forefoot area 56 and the second arm 64 extends along the lateral side 66 of the sole 22 and toward the heel area 58. The first and second arms 62, 64 of the lateral part 46 of the body 36 each extend beyond the ends 60*a*, 60*b* of the central part 42. It should be appreciated that the lengths of the first arm 62 and the second arm 64 may be any suitable lengths, and may be the same or different from each other. In this embodiment, the asymmetrical shape of the body 36 having the curved central part 42 (i.e., the protruding member or raised rib) provides stiffness in a midfoot area 68 of the sole 22 while also providing torsional stiffness across the body 36 with increased flexibility on the medial and lateral sides 54 and 66 of the sole 22.

In the illustrated embodiment, the lengths of the first arm 50 of the medial part 44 and the first arm 62 of the lateral part 46 are approximately the same. In another embodiment, the lengths of the first arms 50 and 62 of the medial part and the lateral part are different. For example, the first arm 50 of the medial part 44 may extend further into the forefoot area 56 than the first arm 62 of the lateral part 46. In another embodiment, the first arm 62 of the lateral part 46 extends further into the forefoot area 56 than the first arm 50 of the medial part 44. Also as shown, the second arm 52 of the medial part 44 has a length that is greater than the length of the second arm 64 of the lateral part 46. In this way, the support member 34 provides more support to the medial side 54 of the sole 22 than the lateral side 66 of the sole 22, such as for runners with feet that roll to the inside (toward the medial side) during movement, i.e., pronation. In another embodiment, the lengths of the first arm 62 and/or the second arm 64 of the lateral part 46 are greater than the lengths of the first arm 50 and/or the second arm 52 of the medial part 44 to provide additional support to the lateral side 66 of the sole 22, such as for runners with feet that roll to the outside (toward the lateral side) during movement, i.e., supination. It should be appreciated that the lengths of the first arms 50, 62 and the second arms 52, 64 of the medial part and the lateral part may all be the same or one or more of the lengths of the first arms 50, 62 and the second arms 52, 64 may be different from the other arms. Referring to FIGS. 3 and 5, in an embodiment, the first and second arms 50 and 52 of the medial part 44 of the body 36 are spaced from the medial side 54 of the sole 22 and the first and second arms 62, 64 of the lateral part 46 of the body 36 are each spaced from the lateral side 66 of the sole 22.

In the above embodiments, the curved central part 42, i.e., central rib, of the body 36 of the support member 34 provides rigid support to a central area, such as in the midfoot area 68, of a user's foot and also provides resiliency that helps propel the user's feet forward. More specifically, the central part 42 provides stiffness in the central area of the foot while the extended first and second arms of the body 36 provide graduated flexibility and control on the medial and lateral sides 54, 66 of the sole 22. In this way, the support member 34 is adaptable to a user's body weight, gait, speed and terrain on which the user is walking or running. Further, the support member 34 is preferably made of a lightweight material, such as a carbon composite material, that does not add significant weight to the sole 22 so that the sole remains relatively lightweight. As such, the stiffness in the central area of the support member 34 and flexibility on the medial and lateral sides 54 and 66 of the sole enhances the efficient transfer of energy from the heel area 58 to the forefoot area 56 of a user's feet while helping the user to move in a forward direction.

Figure 7:
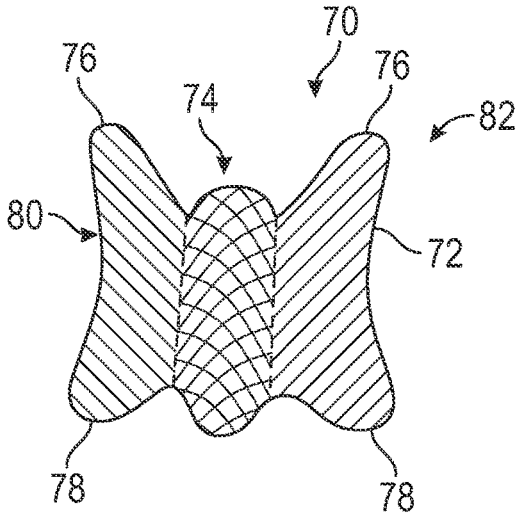
FIG. 7 is a top view of another embodiment of the support member.

Referring to FIG. 7, another embodiment of the support member is illustrated where the support member 70 includes a body 72 having a central part 74 or central rib with a curved, convex shape and front and rear arms 76, 78 extending at an angle from the central part on the medial and lateral sides 80, 82 of the body. As shown, the front arms 76 are the same length and the rear arms 78 are the same length, i.e., the front and rear arms extend at the same distance from the body. In this embodiment, the front and rear arms 76, 78 are compact and extend a short distance from the body 72 to concentrate the support of the support member 70 to a specific area of the sole such as the midfoot area or forefoot area of the sole.

Figure 8:
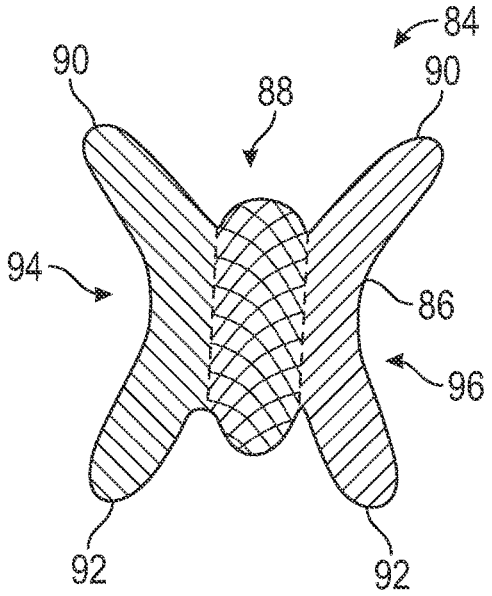
FIG. 8 is a top view of a further embodiment of the support member.

Referring to FIG. 8, a further embodiment of the support member is illustrated where the support member 84 includes a body 86 having a central part 88 or central rib with a curved, convex shape and front and rear arms 90, 92 extending at an angle from the central part on the medial and lateral sides 94, 96 of the body. In this embodiment, the front arms 90 are the same length and the rear arms 92 are the same length, i.e., the front and rear arms extend at the same distance from the body, where the length of the front and rear arms is greater than a length of the front and rear arms in the embodiment shown in FIG. 7. This configuration enables the support member 84 to provide support to a larger area of the sole 22 and also provides more flexible control on the medial and lateral sides 94, 96 of the sole.

Figure 9:
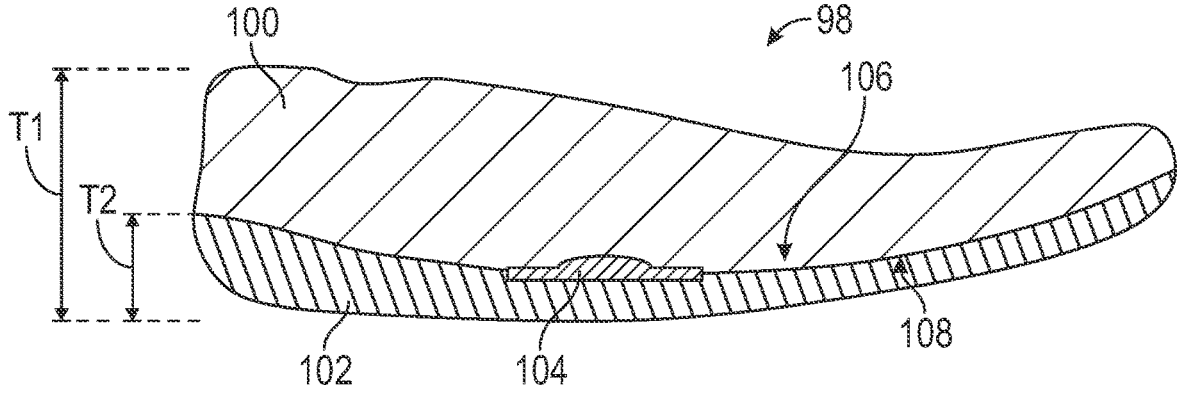
FIG. 9 is a side view of another embodiment of the sole where the sole includes multiple layers and a support member positioned between the layers.

Referring to FIG. 9, another embodiment of the sole is shown where the sole 98 includes multiple layers, such as a first layer 100 and a second layer 102, and a support member 104 positioned between the first layer and the second layer. The support member 104 is configured with a size and shape based on one or more of the support members described above. In this embodiment, the first and second layers 100 and 102 of the sole 98 are each made of a material that is compressible such as a foam material, EVA, TPU or other suitable material or combination of materials. As shown, the support member 104 is partially embedded in the first and second layers 100 and 102 when the first and second layers are pressed and secured together in the manufacturing process. In another embodiment, the bottom surface 106 of the first layer 100 and the upper surface 108 of the second layer 102 each have recessed areas (not shown) that correspond to the size and shape of the support member 104 such that the support member is seated in the recessed areas when the sole is manufactured. In an embodiment, the thickness T2 of the second layer is 30% to 33% of the overall thickness T1 of the midsole. It should be appreciated that the first layer 100 and the second layer 102 may have the same thicknesses or different thicknesses.

Figure 10:
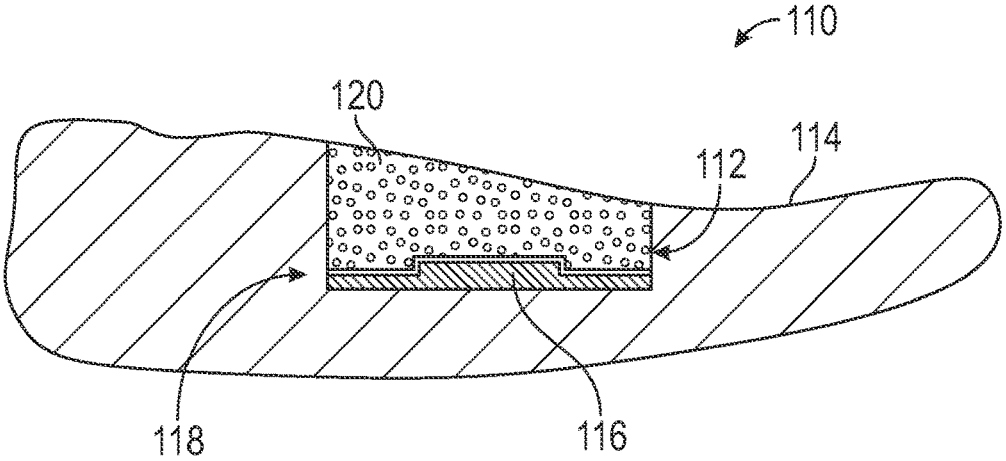
FIG. 10 is a side view of a further embodiment of the sole where the sole includes recessed area and a support member and cushion member in the recessed area.

Referring to FIG. 10, a further embodiment of the sole is shown where the sole 110 includes a recessed area 112 formed in the upper surface 114 of the sole. A support member 116 is positioned on a surface of the sole 110 at the bottom end 118 of the recessed area. The support member 116 is configured with a size and shape based on one or more of the support members described above. In this embodiment, the support member 116 is positioned on the bottom end 118 of the recessed area 112 without being secured to the sole. In another embodiment, the support member 116 is attached to the sole 110 in the recessed area 112 by an adhesive or other suitable attachment method. A cushion member 120 is placed on the support member 116 in the recessed area 112. The cushion member 120 may be made with a foam material, EVA, TPU or any suitable material or combination of materials. In another embodiment, a plurality of cushion members 120 are inserted in the recessed area 112 and on the support member 116. The cushion member 120 may be inserted in the recessed area 112 without being attached to the sole 110 or attached to the sole and/or the support member using an adhesive or other suitable attachment method. It should be appreciated that the recessed area 112 may be any size and shape.

Figure 11A:
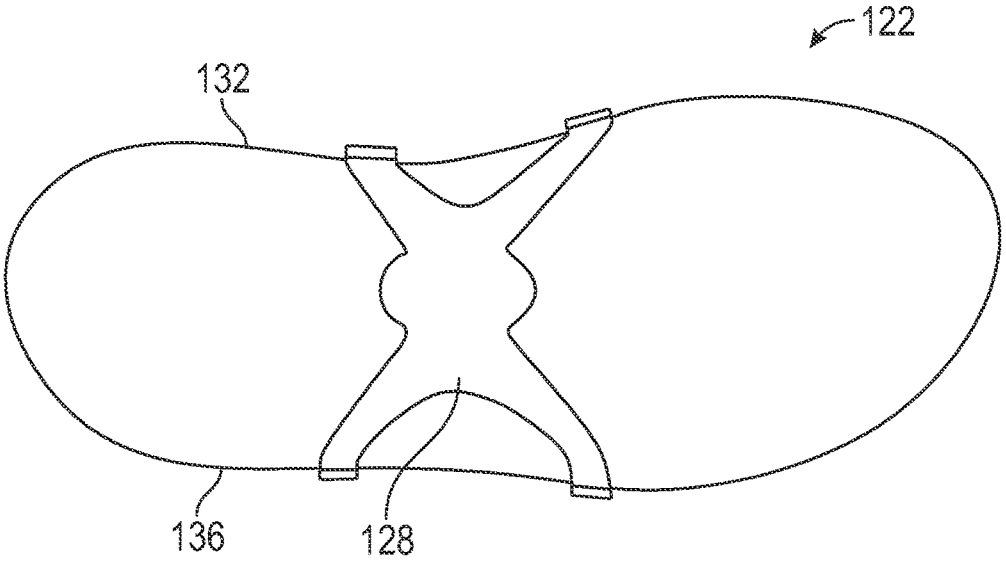
FIG. 11A is a top view of another embodiment of the support member where the support member has medial and lateral arms that extend to the medial and lateral sides of the sole.
Figure 11B:
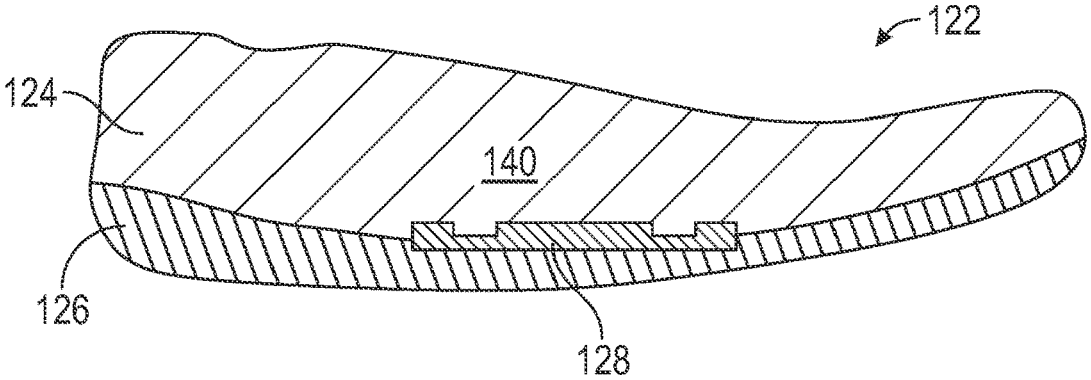
FIG. 11B is a side view of the support member and sole of FIG. 11A.
Figure 11C:
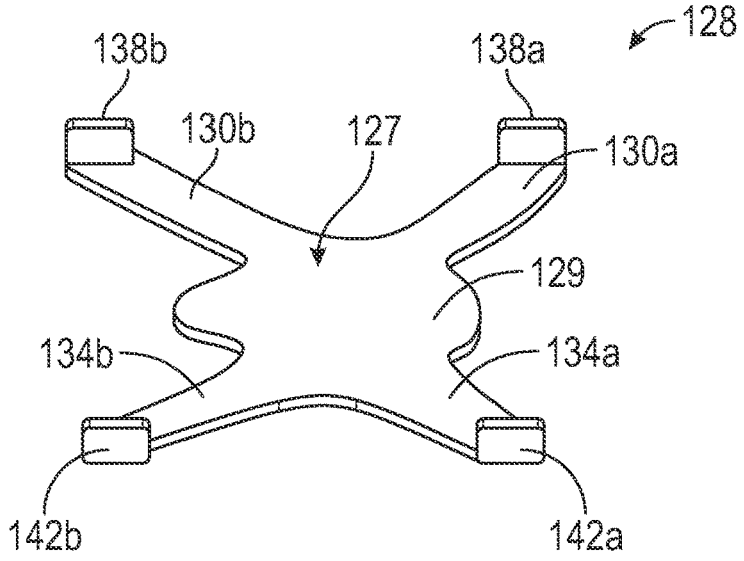
FIG. 11C is a perspective view of the support member of FIG. 11A.
Figure 11D:
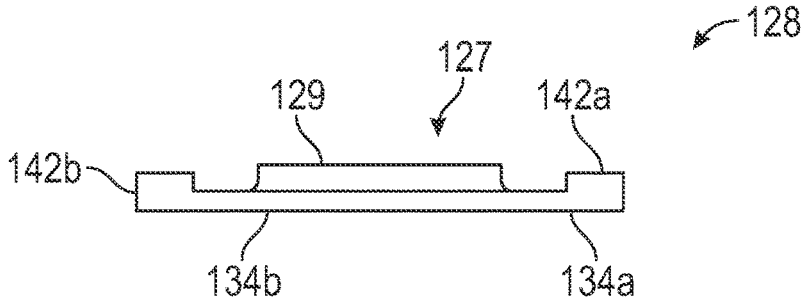
FIG. 11D is a side view of the support member of FIG. 11C.
Figure 11E:
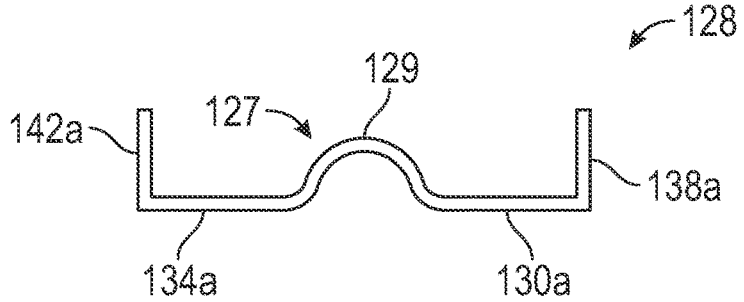
FIG. 11E is a front view of the support member of FIG. 11C.

Referring to FIGS. 11A to 11E, another embodiment of the sole is illustrated where the sole 122 (or midsole) includes a first layer 124 and a second layer 126 as described above. In this embodiment, a support member 128 is positioned between the first layer 124 and the second layer 126. As shown in FIGS. 11C to 11E, the support member 128 has a central part 127 with a protruding member or rib 129 having a curved shape and medial arms 130*a*, 130*b* that extend to medial side 132 of the sole 122 and lateral arms 134*a*, 134*b* that extend to the lateral side 136 of the sole 122. In this embodiment, the medial arms 130*a*, 130*b* include medial supports 138*a*, 138*b* that are located at the ends of the medial arms and transversely extend at least partially along an outer surface 140 (FIG. 11B) of the first layer 124. Similarly, the lateral arms 134*a*, 134*b* include lateral supports 142*a*, 142*b* that are located at the ends of the lateral arms and transversely extend at least partially along the outer surface 140 of the first layer 124. The medial supports 130*a*, 130*b* and lateral supports 134*a*, 134*b* may extend along a portion of the outer surface 140 or along the entire outer surface 140 of the first layer 124. Extending the medial supports and the lateral supports at least partially along the outer surface 140 helps to secure the support the medial supports 130*a*, 130*b* and member 128 in place on the sole 122 and helps to reduce lateral movement of the support member during use.

Figure 12:
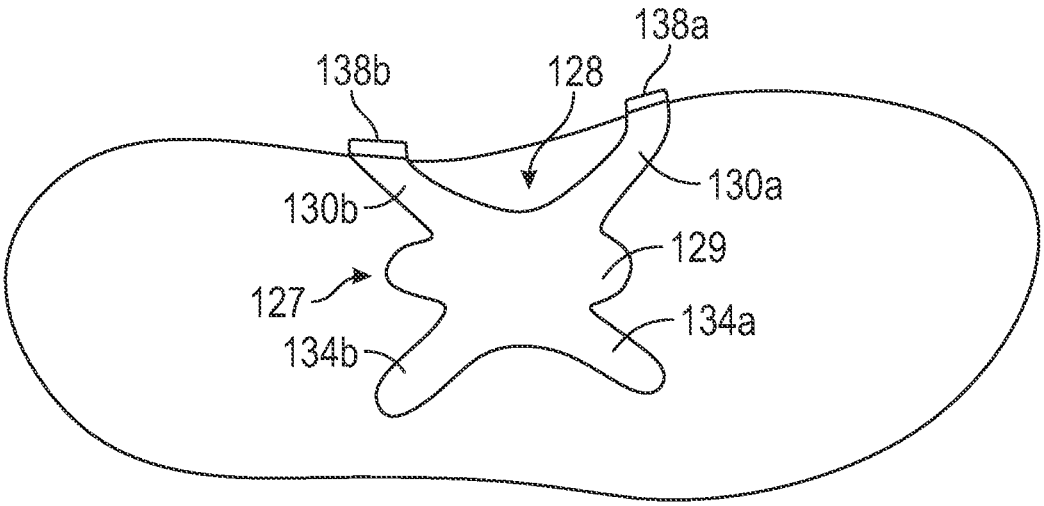
FIG. 12 is another embodiment of the support member where the support member includes arms extending to a medial side of the sole.
Figure 13:
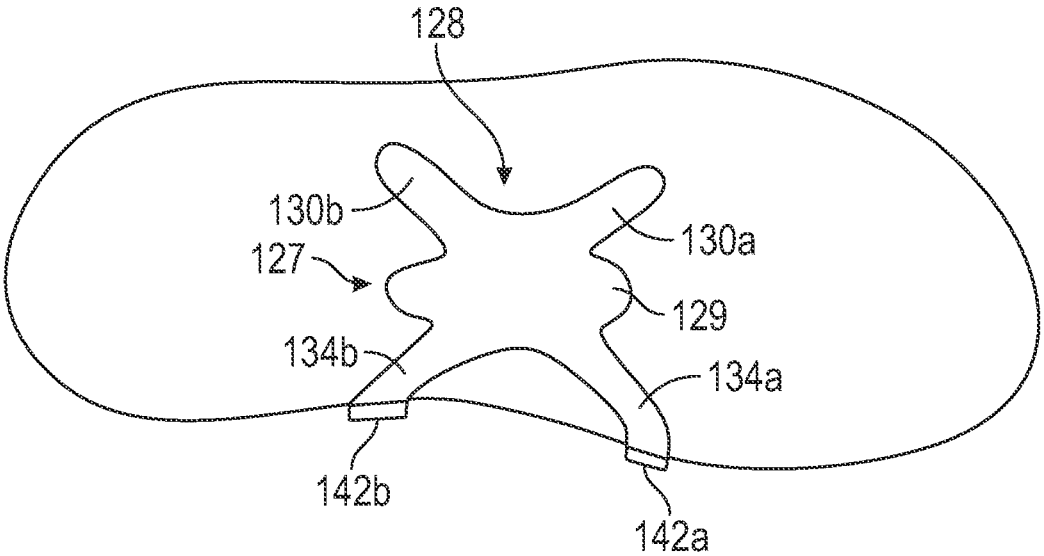
FIG. 13 is a further embodiment of the support member where the support member includes arms extending to a lateral side of the sole.
Figure 14:
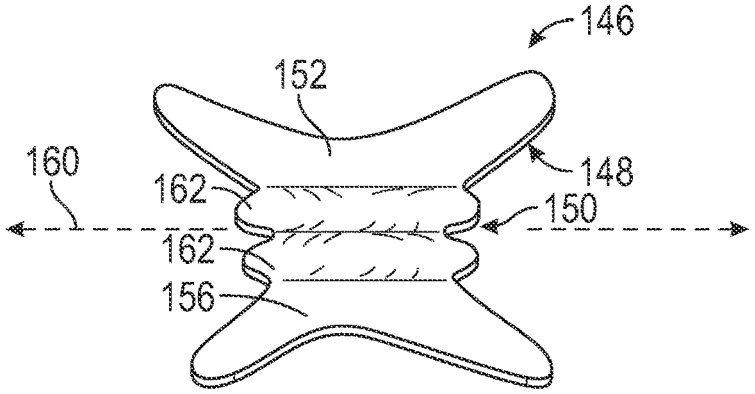
FIG. 14 is a perspective view of another embodiment of the support member where the support member includes multiple protruding members.
Figure 15:
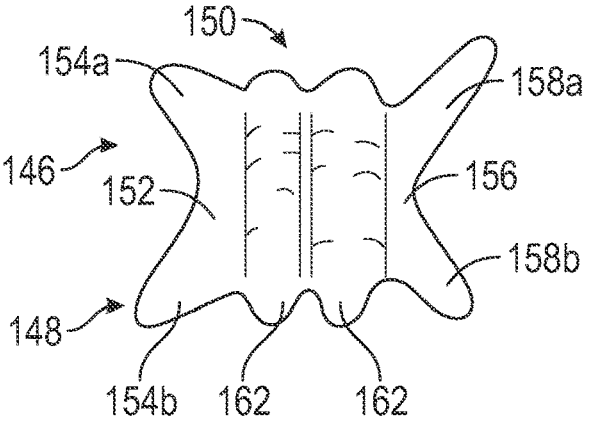
FIG. 15 is a top view of the support member of FIG. 14.
Figure 16:
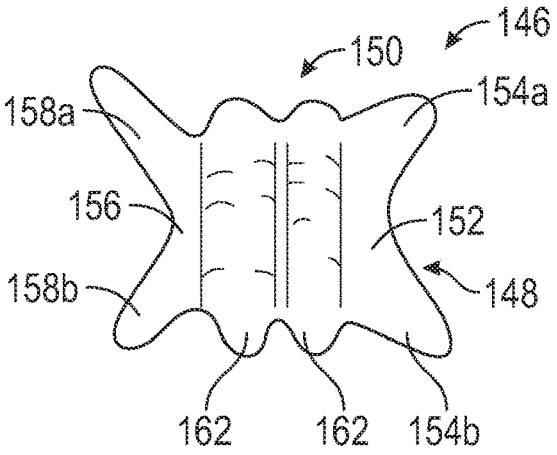
FIG. 16 is a bottom view of the support member of FIG. 14.
Figure 17:
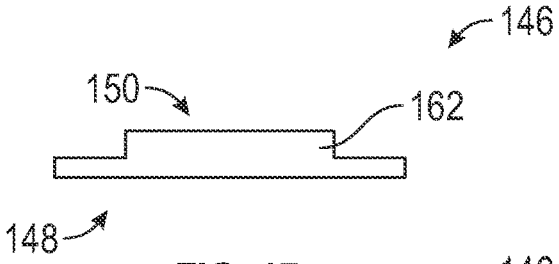
FIG. 17 is a side view of the support member of FIG. 14.
Figure 18:
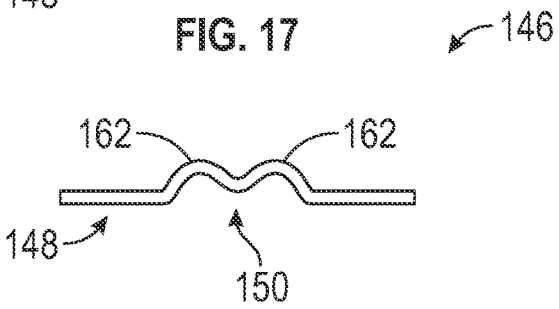
FIG. 18 is a front view of the support member of FIG. 14.

In another embodiment shown in FIG. 12, the medial arms 130*a*, 130*b* extend to the medial side 132 of the sole 122 and the lateral arms 134*a*, 134*b* extend along a portion of the upper surface 144 of the sole 122 but do not extend to the lateral side 136 of the sole. The configuration of the medial arms 130*a*, 130*b* in this embodiment provide additional support to the medial side 132 of the sole 122 such as for users that pronate during movement. In FIG. 13, a further embodiment is shown where the lateral arms 134*a*, 134*b* of the support member 128 extend to the lateral side 136 of the sole 122 and the medial arms 130*a*, 130*b* extend along a portion of the upper surface 144 of the sole 122 but do not extend to the medial side 132 of the sole 122. The configuration of the lateral arms 134 in this embodiment provide additional support to the lateral side 136 of the sole 122 such as for users that supinate during movement. In other embodiments, one or more of the medial arms 130*a*, 130*b* and the lateral arms 134*a*, 134*b* extend to the medial side 132 and/or the lateral side 136 of the sole 122 based on the desired level of support.

Referring to FIGS. 14 to 18, another embodiment of the support member is shown where the support member 146 includes a body 148 having a central part 150 and a medial part 152 with medial arms 154*a* and 154*b* extending from the body toward the medial side of a sole and a lateral part 156 with lateral arms 158*a* and 158*b* extending from the body 148 toward the lateral side of the sole. As described above, the medial arms 154*a*, 154*b* and the lateral arms 158*a*, 158*b* may extend transversely relative to a longitudinal axis 160 of the body 148 or extend at the same or different angles relative to the longitudinal axis. In the illustrated embodiment, the central part 150 of the body 148 includes two curved protruding members or ribs 162 that each extend along the longitudinal axis 160 of the body. The protruding members 162 may be directly adjacent to each other or spaced apart by a designated distance. It should be appreciated that the central part 150 of the body 148 may have a single protruding member or rib as described above or two or more protruding members or ribs. Forming the central part 150 of the body 148 with multiple protruding members or ribs provides additional support in the central area of the support member 146 and thereby provides additional support to a user's foot during movement. In this embodiment, the body 148 may have a uniform thickness or different thicknesses. It should be appreciated that the terms "arm" and "member" are used to describe certain features of the above embodiments and may be used interchangeably without limiting the structure of the embodiments.

The support member in each of the above embodiments is preferably made with a high strength carbon composite material such as a carbon fiber-reinforced material. It is also contemplated that the support member may be made with a metal material, rubber, EVA, TPU, a foam material or any suitable material or combination of materials. Furthermore, the medial part, the central part and the lateral part of the body may be made with the same material or one or more different materials.

In an embodiment, the support member described in the above embodiments is placed on pins inside a mold, such as a 1:1 injection mold, and is co-molded with the sole or midsole during the molding process. It should be appreciated that the support member may be formed independently or co-molded with the sole or midsole in a press molding process, an injection molding process or in any suitable manufacturing process. In an embodiment, the support member is formed in an injection molding process and is made with 30% to 40% short fiber carbon and polyamide.

In the above embodiments, the support member provides dynamic stability for a user by reducing unnecessary medio-lateral movement of the foot while limiting unwanted shearing and compression of the sole. The support member also provides a desired level of support to a user during movement to assist with the transfer of energy generated from the user's legs and body.

While particular embodiments of the present support member are shown and described, it will be appreciated by those skilled in the art that changes and modifications may be made thereto without departing from the invention in its broader aspects and as set forth in the following claims.

What is claimed is:

1. A sole for an article of footwear, the sole comprising:
a sole including a midsole and an outsole, the outsole being attached to the midsole, said sole including a medial side and a lateral side; and
a support member positioned between said midsole and said outsole, said support member including a body having a medial side, a lateral side and a central part between said medial side of said body and said lateral side of said body, said central part has a vertically oriented curvature extending between said medial side of said body and said lateral side of said body that forms a single space below said central part, said single space extending longitudinally from a front edge of said body to a rear edge of said body, said medial side of said body and said lateral side of said body each including a plurality of arms respectively extending toward said medial side of said sole and said lateral side of said sole, wherein said single space spans an entire width of said central part, and wherein said central part extends from said plurality of arms of said medial side of said body to said plurality of arms of said lateral side of said body,
wherein (i) said plurality of arms on said medial side of said body are spaced from a medial edge of said sole, or (ii) said plurality of arms on said lateral side of said body are spaced from a lateral edge of said sole.

2. The sole of claim 1, wherein said plurality of arms extend from said medial side of said body and said lateral side of said body at an angle relative to a longitudinal axis of said body.

3. The sole of claim 1, wherein said plurality of arms extend from said medial side of said body and said lateral side of said body of said support member and are asymmetrical relative to a longitudinal axis of said body.

4. The sole of claim 1, wherein a thickness of said central part of said body is greater than a thickness of each of said medial side of said body and said lateral side of said body.

5. The sole of claim 1, wherein said body of said support member has a uniform thickness.

6. The sole of claim 1, wherein said body of said support member has a thickness of 1.5 mm.

7. The sole of claim 1, wherein at least one of said plurality of arms on said medial side of said body has a length that is greater than a length of each of said plurality of arms on said lateral side of said body.

8. The sole article of footwear of claim 1, wherein a length of said plurality of arms on said medial side of said body is equal to a length of said plurality of arms on said lateral side of said body.

9. The sole of claim 1, wherein said support member is located in a midfoot area of said sole.

10. The sole of claim 1, wherein said body of said support member is made of one of a carbon composite material, a carbon fiber-reinforced material, a metal material, ethylene-vinyl acetate, thermoplastic polyurethane and a foam material.

11. An article of footwear comprising the sole of claim 1.

* * * * *